United States Patent [19]

Stark

[11] 4,304,214

[45] Dec. 8, 1981

[54] SYSTEM OF WOOD COMBUSTION EMPLOYING FORCED DRAFT

[76] Inventor: I. Bruce Stark, Rte. 5, P.O. Box 369, Staunton, Va. 24401

[21] Appl. No.: 58,616

[22] Filed: Jul. 18, 1979

[51] Int. Cl.[3] ..... F24B 5/00; F23B 5/02

[52] U.S. Cl. ..... 126/79; 110/207

[58] Field of Search ..... 126/79; 110/204, 205, 110/206, 207

[56] References Cited

U.S. PATENT DOCUMENTS

| | | | |
|---|---|---|---|
| 554,499 | 2/1896 | Schnigge | 126/79 |
| 606,667 | 7/1898 | Humphreys | 126/79 |
| 3,933,145 | 1/1976 | Reich | 126/79 |

*Primary Examiner*—Samuel Scott
*Assistant Examiner*—Wesley S. Ratliff, Jr.
*Attorney, Agent, or Firm*—Birch, Stewart, Kolasch and Birch

[57] ABSTRACT

A system of wood combustion employing forced draft is disclosed and comprises a forced draft air and flue arrangement which is utilized with a typical wood heater or wood stove. The forced air and flue arrangement includes a blower, a plenum on which the blower is attached, a panel to which the plenum is attached having air inlets formed therethrough, the air inlets being internal to the plenum, and a flue arrangement attached to the other side of the panel. The flue arrangement includes ducts leading from the air inlets, the ducts having air nozzle slits formed on the other end thereof which are communicable with the internal portions of the wood heater or wood stove. Forced air from the blower enters the combustion chamber through the air nozzle slits. Immediately adjacent to the air nozzle slits and formed as a portion of the flue arrangement is an internal flue outlet for providing an exhaust exit for combustion gases, the flue outlet being communicable with an exhaust pipe. This forced draft air and flue arrangement provides for more complete combustion by combining secondary combustion of the excess air and unburned combustibles released during a previous primary combustion with the current primary combustion of the wood fuel thereby minimizing the amount of excess air and unburned combustibles and thereby improving the combustion efficiency of the wood stove. This is accomplished by forcing the combustion exhaust gases which are attempting to exit through the flue outlet to recirculate back into the combustion chamber. Directly adjacent locations of the air nozzle slits with the flue outlet causes this forced recirculation of the excess air and unburned combustibles generated during the primary combustion of the wood fuel.

4 Claims, 7 Drawing Figures

SYSTEM OF WOOD COMBUSTION EMPLOYING FORCED DRAFT

BACKGROUND AND SUMMARY OF THE INVENTION

The present invention generally relates to a forced-draft unit for use in conjunction with typical wood heaters or wood stoves in order to increase the combustion efficiency of the wood fuel.

In the prior art, typical wood heaters or wood stoves provided for a fresh air inlet at the bottom portion of one side of the combustion chamber and a flue outlet at the top portion of an opposite side of the combustion chamber. With this arrangement, the fresh air inlet provided air to the combustion chamber which consequently began to rise by virtue of the negative pressure region created by the flue outlet at the top portion of the opposite side of the combustion chamber. As a result, most of the incoming oxygen was not utilized in the combustion process, rather, immediately exited through the flue outlet providing a cooling effect to the wood stove. Further prior art devices attempted to correct this deficiency by providing a secondary combustion whereby the fresh air inlet would recirculate in the combustion chamber prior to exiting the flue outlet. However, by virtue of the locations of the fresh air inlet versus the exhaust gas outlet openings, much of the incoming oxygen remained unutilized with respect to the combustion process when being forced through the exhaust gas outlet and into the atmosphere. Even though some degree of secondary combustion was taking place, excess air within the exhaust gases still remained unutilized and an excessive quantity of unburned combustibles also remained thereby minimizing the total combustion efficiency, and in particular the efficiency of the secondary combustion process.

The present invention attempts to maximize and further improve the combustion efficiency relative to the above prior art devices, and in particular to improve the efficiency of the secondary combustion process by locating the fresh air inlet immediately adjacent to the flue or exhaust gas outlet opening, and further providing a means for generating a supply of forced draft air through the fresh air inlet so that a substantial quantity of the exhaust gases and unburned combustibles which are attempting to exit through the flue outlet are forced to recirculate back through the combustion chamber because of the high velocity of incoming forced draft air from the air inlet. This structural arrangement creates a secondary combustion, but also increases the efficiency of the secondary combustion by forcing the exhaust gases and unburned combustibles to recirculate and to again recirculate thereby utilizing to a maximum extent the excess air and unburned combustibles remaining in the exhaust gases prior to its eventual exiting through the flue outlet opening and into the atmosphere.

This improved secondary and primary combustion is accomplished by utilizing a blower which is attached to a plenum which is further attached to a panel on which the flue arrangement is mounted. The internal flue arrangement mounted on the interior of the wood stove communicates with the outer atmosphere thereby providing a means for the exiting of the exhaust gases after combustion. The air from the blower enters a set of air inlet openings and is further conducted through a set of ducts and exits through a set of air nozzle slits, is circulated through the combustion chamber creating exhaust gases having a specific quantity of excess air and unburned combustibles. The exhaust gases attempt to exit through the flue outlet opening which is located directly adjacent to the air nozzle slits but is forced to recirculate back into the combustion chamber by virtue of the high velocity incoming air entering the combustion chamber through the air nozzle slits. As a result, combustion efficiency is improved by virtue of the minimization of the excess air and unburned combustibles in the exhaust gases. Since the excess air has a tendency to cool the stove, by minimizing the excess air in the combustion process, a cooling effect of the stove is prevented, and additional heat is created thereby improving the combustion efficiency of the fuel in the stove.

Accordingly, one object of the present invention is to provide an attachment to a typical wood burning stove which will improve the combustion efficiency of the fuel thereby maximizing the heat generation capacity of the stove itself Another object of the present invention is to provide a secondary combustion process as well as a primary combustion process in a singular combustion chamber of the fuel burning stove.

Another object of the present invention is to increase the combustion efficiency of the total combustion by recirculating the exhaust gases created during the combustion process thereby minimizing excess air and unburned combustibles present within the discharged products of combustion.

Another object of the present invention is to carefully choose the size of the forced draft air components to match the size of the combustion chamber thereby improving upon the primary and secondary combustion efficiency of the wood burning stove.

Still another object of the present invention is to eliminate smoke back when the front door of the wood burning stove is opened.

Another object of the present invention is to improve overall heat extraction or heat transfer by means of the inherently high internal turbulence of velocity of incoming forced air provided by the forced draft unit.

Other objects and further scope of applicability of the present invention will become apparent from the detailed description given hereinafter; it should be understood, however, that the detailed description and specific example, while indicating preferred embodiments of the invention, are given by way of illustration only, since various changes and modifications within the spirit and scope of the invention will become apparent to those skilled in the art from this detailed description.

THE BRIEF DESCRIPTION OF THE DRAWINGS

The present invention will become fully understood from the detailed description given hereinbelow and the accompanying drawings which are given by way of illustration only, and thus are not limitative of the present invention, and wherein, FIG. 1 is a three-dimensional frontal exterior view of an embodiment according to the present invention;

DETAILED DESCRIPTION OF THE INVENTION

Figure 1:
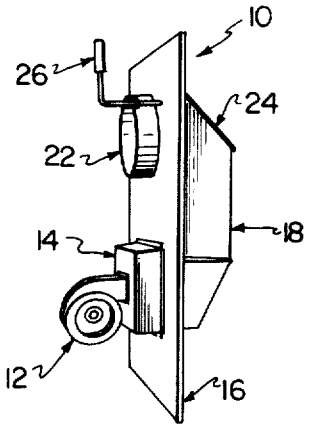

Referring to FIG. 1, a forced draft unit 10 is shown. A blower 12 is attached to a plenum 14 which is further attached to a panel 16. The panel 16 is adapted to be attached to one side of a wood burning or fuel burning stove. An internal flue 18 is attached to the opposite side of the panel relative to the blower 12.

Figure 2:
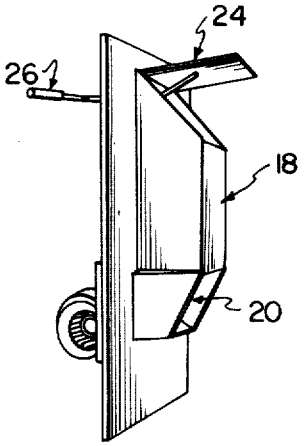
FIG. 2 is a three-dimensional rear interior view of the embodiment of the invention of FIG. 1.

Referring to FIG. 2, the internal flue 18 is shown in greater detail wherein the flue outlet 20 provides the means for the exhaust gases from the combustion process to exit via the flue outlet 20 and ultimately being exhausted to the atmosphere through the air outlet 22 as shown in FIG. 1. An upper cut-off lid 24 may be raised or lowered as shown in FIGS. 1 and 2 by operating a handle 26.

Figure 3:
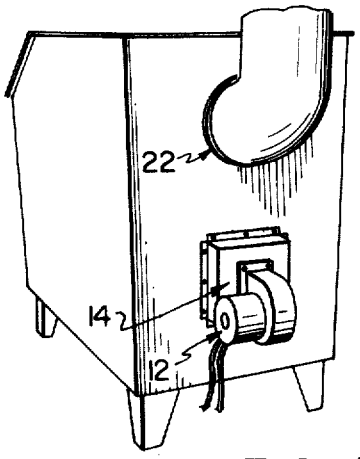
FIG. 3 illustrates the use of the present invention when mounted on a typical wood burning stove.

The forced draft wood burner 10 is shown in FIG. 3 attached to one side of a wood burning stove.

Figure 4:
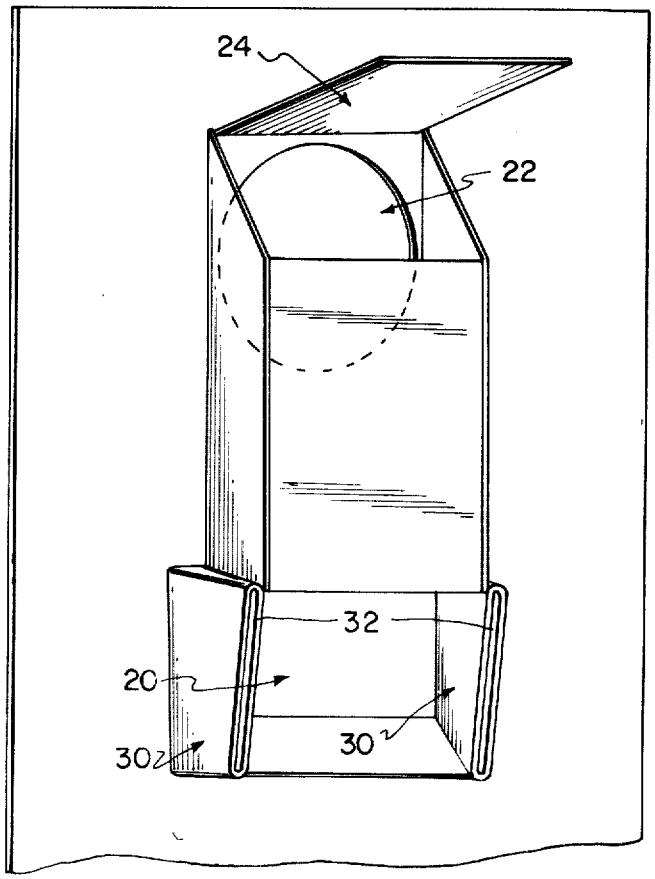
FIG. 4 is a more detailed rear interior view of the embodiment of invention illustrated in FIG. 1.
Figure 5:
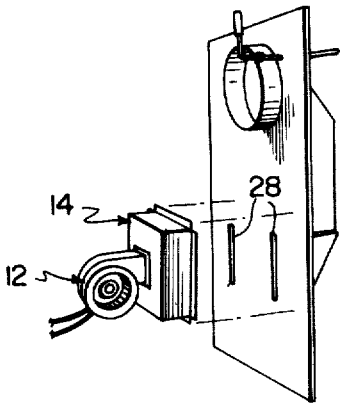
FIG. 5 represents a frontal exterior view of the embodiment of invention which is illustrated in FIG. 1 with a portion of the embodiment removed.
Figure 6:
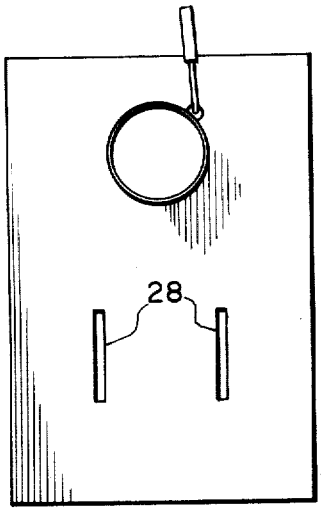
FIG. 6 is a perspective view of the front portion of the embodiment of invention which appears in FIG. 1 clearly illustrating the air inlets leading to the ducts and the air nozzle slits.

Referring to FIG. 5, the blower 12 with its attached plenum 14 is shown disassembled from the panel of the forced draft wood burner. A set of air inlet openings (28) are arranged internal to the housing of the plenum 14. The air inlets 28 communicate with a set of ducts 30 which further communicate with the internal portions of the wood burning stove via a set of air nozzle slits 32 as shown in FIG. 4. Note the close proximity (adjacent position) of the air nozzle slits 32 with the flue outlet 20.

In FIG. 4, the upper cut-off lid 24 can be seen in its raised position further illustrating the position of the air outlet 22 enclosed therein.

The principle of operation of the present invention can be explained by reference to FIG. 7.

Incoming forced air is provided by the blower 12 and further enters the plenum 14 for introduction to the internal compartment of the wood burning stove by entering through the set of air inlet openings 28, conducted through the ducts 30 and exiting through the set of air nozzle slits 32. As the forced draft air enters the combustion chamber of the wood burning stove, primary combustion takes places near the vicinity of the fuel generally indicated in FIG. 7 as being a wood fuel. Exhaust gases are released, these gases including a specific quantity of preheated excess oxygen and unburned combustibles released from the wood fuel during primary combustion. Since the flue outlet 20 is directly adjacent to the set of air nozzle slits 32, the exhaust gases being released from the fuel during the primary combustion process attempt to exit through the flue outlet 20 for exhaust to the atmosphere. However, the exhaust gases, the products of the primary combustion, are prevented from exiting through the flue outlet 20 in large part by the continual supply of forced air from blower 12 being forced through the set of air nozzle slits 32. As a result, the exhaust gases are recirculated back through and into the vicinity of the fuel generally indicated by the arrows 34 in FIG. 7. The arrows 34 are representative of products of combustion which contain unburned combustibles and a fresh supply of oxygen from blower 12. The exhaust gases 34 carry an excess amount of oxygen which has been preheated during the primary combustion process. The excess preheated oxygen within the exhaust gases is utilized in a secondary combustion process which takes place after the primary exhaust gases and unburned combustibles (which are attempting to exit through the flue outlet 20) are recirculated back into the combustion chamber of the wood burning stove.

The secondary combustion process involves the utilization of the excess preheated oxygen generated during the primary combustion to assist in the combustion of the unburned combustibles also generated during the primary combustion of the wood fuel.

Most of the excess oxygen and unburned combustibles, generated during primary combustion, are forced to recirculate back into the combustion chamber without entering the flue outlet 20 due to the forced draft air from blower 12 exiting through the air nozzle slits 32. After recirculation, most of the excess oxygen and unburned combustibles, generated during primary combustion of the wood fuel, are consumed in a secondary combustion process. As a result, primary and secondary combustion takes place simultaneously within the combustion chamber of the wood burning stove. This combined primary and secondary combustion is generically described as TOTAL combustion.

Figure 7:
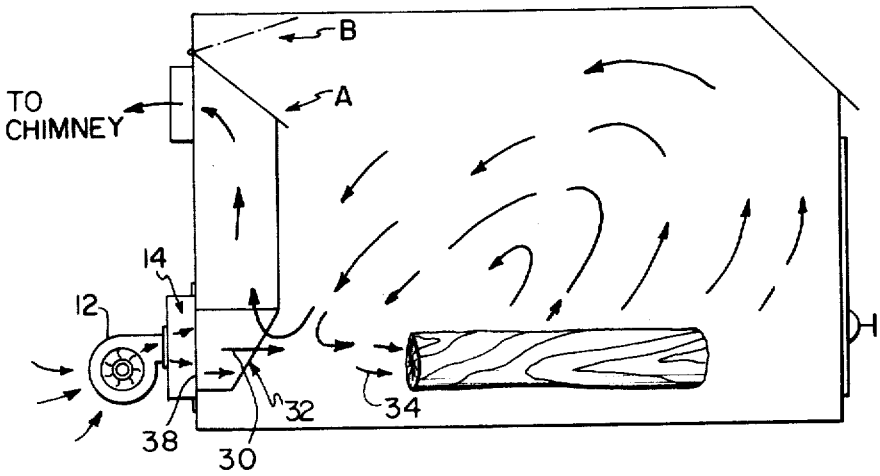
FIG. 7 illustrates the principle of operation of the embodiment which appears in FIG. 1 in connection with its use with a wood burning stove.

Consequently, a continual recirculation of the exhaust gases takes place within the internal portion of the wood burning stove in the vicinity of the burning fuel as shown in FIG. 7. Eventually, some of the exhaust gases do escape into the flue outlet opening 20 and subsequently out through the air outlet 22 for exhaust to the atmosphere. However, the exhaust gases at this point have a minimal supply of excess oxygen and unburned combustibles by virtue of the continual recirculation taking place within the combustion chamber of the wood burning stove. This continual recirculation is primarily the result of the close and almost directly adjacent proximity of the set of air nozzle slits 32 with the flue outlet opening 20.

The secondary and primary combustion both take place in the same general area of the combustion chamber and they are both supplied with oxygen from a singular source i.e.-from the air nozzle slits. The Secondary combustion process has first priority to the fresh supply of oxygen supplied from the air slits 32 since the unburned combustibles of the prospective flue gases attempting to exit through the flue outlet 20 are mixed with the incoming oxygen from the air nozzle slits 32 and recirculated back into the combustion chamber. At that point; any "excess" oxygen remaining after secondary combustion of the unburned combustibles is free to support more primary combustion. The primary and secondary combustion processes represent a continuous and simultaneous process, with the primary combustion having access to oxygen remaining after the second combustion process takes place. This utilization of secondary combustion to consume the unburned combustibles generated during primary combustion using the excess oxygen remaining after primary combustion is primarily responsible for the high combustion efficiency of this invention.

As is evident from the drawing in FIG. 4, the air nozzle slits 32 are directly adjacent of the flue outlet 20. Consequently, most of the exhaust gases attempting to exit through the flue outlet 20 is recirculated back into the combustion chamber of the wood burning stove by virtue of the forced draft air being supplied through the directly adjacent set of air nozzle slits 32. This construction of inlet versus outlet opening and their very close proximity relative to each other increases the efficiency of combustion of the fuel internal to the wood burning stove by minimizing the amount of excess air exiting through the air outlet opening 22. The excess air has been responsible for a cooling effect which takes place by virtue of the presence of the excess air in the exhaust gases. Consequently, it is advisable to minimize to as large an extent as possible the quantity of excess air present within the exhaust gases being exhausted to the atmosphere through the air outlet opening 22.

Because of the recirculation principle mentioned above, much of the excess air and unburned combustibles present in the exhaust gases are consumed in the secondary and primary combustion process prior to exiting through the flueoutlet 20. This minimizes the cooling effect which would otherwise take place by virtue of the presence of the excess air in the exhaust gases. As previously described, the very close or directly adjacent proximity of the air nozzle slits 32 providing the incoming forced draft air of high velocity with the flue outlet opening 20 is primarily responsible for the minimization of the excess air and unburned combustibles in the exhaust gases and, as a result, the minimization of the above mentioned cooling effect created by the presence of the excess air in the exhaust gases.

For optimum efficiency it is important that the sizing of the forced air components in this system be matched with the size and configuration of the combustion chamber internal to the wood burning stove. For example, the efficiency of blower 12 as well as the size of plenum 14 and the size of the air inlet opening 28 and consequently the size of the air nozzle slits 32 must be chosen carefully relative to the size of the internal combustion chamber of the wood burning stove such that the proper portion and velocity of incoming forced draft air versus exhaust gases generated by the combustion will maximize the efficiency of the total combustion process. Consequently, to maximize the efficiency and control the rate of the combustion process, the proper size of the forced air components must be selected in the proper proportion relative to the size of the combustion chamber.

The blower 12 may be controlled in a number of different ways, all of which would include the necessary safety and limit controls since the device is capable of producing remarkably greater heat output than a conventional natural draft unit of the same size.

Various methods of blower control include:

1. simple ON-OFF switch.
2. room thermostat
3. stove thermostats and
4. variable-speed blower and controller It must be emphasized that the subject invention is primarily responsible for improving the efficiency of the primary and secondary combustion process and not for controlling the rate of combustion although this too can be controlled through component sizing. As mentioned above, the efficiency of the total combustion process relates to the close proximity of the air nozzle slits 32 with the flue outlet 20 such that the exhaust gases are forced to recirculate through and into the general area of the fuel in the wood burning stove thereby minimizing the quantity of excess air and unburned combustibles present within the exhaust gases prior to eventual exhaust into the atmosphere.

The subject invention relates to neither forced draft nor secondary combustion. It does, however, relate to the improvement of the efficiency of the total combustion process by locating the forced draft air inlet and the flue outlet openings in close proximity relative to one another in order to achieve vastly reduced excess air and unburned combustibles present within the exhaust gases and therefore a resultant improved combustion efficiency. The subject invention, by reducing the quantity of excess air and unburned combustibles to near zero proportion prior to exhaust to the atmosphere, provides for a greatly improved combustion efficiency relative to the prior art devices of this kind.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A unit for use with wood burning stove, said unit adapted to be a portion of one side of said wood burning stove and creating a total combustion including a primary and a secondary combustion of the fuel within said wood burning stove, said unit improving the combustion efficiency of said total combustion by minimizing the quantity of excess air and unburned combustibles present within the exhaust gases released during said primary and secondary combustion, said unit comprising:

a blower means for providing a supply of forced air to the combustion chamber of said wood burning stove;

a panel having an air inlet opening means interposed through one portion of said panel;

said blower means being mounted on one side of said panel and enclosing said air inlet opening means on said one side of said panel;

said panel having an air outlet opening means interposed through another portion of said panel;

a flue means mounted on the other side of said panel and covering said air inlet opening means and said air outlet opening means on said other side of said panel, said flue means including a flue outlet means communicating with said air outlet opening means for releasing the exhaust gases generated during said primary and secondary combustion to the atmosphere;

said flue means further including nozzle means enclosing said air inlet opening means on said other side of said panel for conducting said forced air from said blower means at a substantial velocity through said air inlet opening means and through said nozzle means into the combustion chamber of said wood burning stove, said nozzle means preheating said forced air when said air is conducted from said air inlet means through said nozzle means; and said nozzle means being located in juxtaposition with said flue outlet means, said forced air exiting said nozzle means forcedly recirculating the exhaust gases created during said total combustion which are attempting to exit through said flue outlet means thereby generating said secondary combustion in addition to said primary combustion;

whereby said excess air and unburned combustibles present within said exhaust gases are consumed during said secondary combustion thereby increasing the total combustion efficiency of said wood burning stove.

2. The unit in accordance with claim 1 wherein said air inlet opening means comprises:

a first and a second elongated opening in said panel; and said nozzle means comprising a first duct and a second duct, one end of said first duct covering said first elongated opening on said other side of said panel, one end of said second duct covering said second elongated opening on said other side of said panel, the other end of said first and second ducts having slit means formed therein for conducting and preheating said forced air being conducted from said blower means through each of said slit means into the combustion chamber of said wood burning stove.

3. The unit in accordance with claim 2, wherein said flue outlet means is placed in juxtaposition between said slit means on said first duct and said slit means on said second duct; and wherein substantial quantities of the exhaust gases generated during said primary and said secondary combustion are forcedly recirculated into the combustion chamber of said fuel burning stove in response to the forced air entering the combustion chamber via said slit means.

4. The unit in accordance with claim 3, wherein said flue means further comprises:

an upper cut-off lid means covering the top portion of said flue means including said air outlet opening means, one end of said cut-off lid means being pivotably mounted to said panel on said other side of said panel and near the said another portion of said panel, said upper cut-off lid means capable of being raised and lowered; and handle means connected to said cut-off lid means and protruding through said panel to said one side of said panel for raising and lowering said upper cut-off lid means.

* * * * *